US006654043B2

(12) United States Patent
Inage et al.

(10) Patent No.: US 6,654,043 B2
(45) Date of Patent: Nov. 25, 2003

(54) PRINTER CAPABLE OF CONTROLLING TIMING OF EXPOSURE

(75) Inventors: Toshiyuki Inage, Kawagoe (JP); Kenji Mito, Higashimurayama (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/941,860

(22) Filed: Aug. 30, 2001

(65) Prior Publication Data

US 2002/0024587 A1 Feb. 28, 2002

(30) Foreign Application Priority Data

Aug. 31, 2000 (JP) ..... 2000-263952

(51) Int. Cl.[7] ..... B41J 2/435
(52) U.S. Cl. ..... 347/248; 347/234
(58) Field of Search ..... 347/37, 139, 215, 347/262, 264, 234, 248; 271/270, 272; 377/3, 17, 53

(56) References Cited

U.S. PATENT DOCUMENTS 4,366,372 A * 12/1982 Sargent ..... 377/3
5,181,715 A * 1/1993 Ohkoda et al. ..... 271/272
5,748,206 A * 5/1998 Yamane ..... 347/37
5,926,192 A 7/1999 Yamane ..... 347/10
6,262,757 B1 7/2001 Masubuchi et al. ..... 347/225

FOREIGN PATENT DOCUMENTS

| | | |
|---|---|---|
| EP | 0 941 861 | 9/1999 |
| EP | 0 972 646 | 1/2000 |
| JP | 58062831 | 4/1983 |

* cited by examiner

*Primary Examiner*—Hai Pham
(74) *Attorney, Agent, or Firm*—Finnegan, Henderson, Farabow, Garrett & Dunner, L.L.P.

(57) ABSTRACT

A printer for executing recording onto media, including a head and a rotary encoder, wherein the head and the media are moved relatively. In the relative movement between the head and the media, the media may be moved relative to the immobile head, or the head may be moved relative to the immobile media. The rotary encoder outputs pulses corresponding to relative positions between the head and the media. The head starts recording onto the media based on the pulses output by the rotary encoder. When the pulses from the rotary encoder have not been output within a predetermined period of time, the printer starts recording onto the media based on a lapse of the predetermined period of time.

16 Claims, 12 Drawing Sheets

0V
0V
0V
0V
B
Td
Ts
R1
G1
B1
R2
G2
B2
R1
G1
B1
R2
G2

PRINTER CAPABLE OF CONTROLLING TIMING OF EXPOSURE

BACKGROUND OF THE INVENTION

1. Field of the Invention

The present invention relates to a printer for executing an exposure on a photosensitive material. The invention particularly relates to a printer which carries out control of exposure based on encoder pulses.

2. Description of the Related Art

In an optical printer for executing exposure by a light head, while moving a photosensitive material, pulses are generated in synchronism with the movement of the photosensitive material in order to control timing of the exposure. Then, based on these pulses, the optical printer controls the timing of the exposure. In order to generate pulses synchronous with the movement of the photosensitive material, there has been used a rotary encoder having a large number of slits on a disc, or the like. The rotary encoder is rotated in synchronism with the movement of the photosensitive material. Then, the pulses are generated corresponding to the slits in synchronism with the rotation of the rotary encoder.

However, according to this method, there has been a problem in that when a dust or the like has entered in one of the plurality of slits, it is not possible to generate a pulse corresponding to the slit in which the dust has entered. As a result, it is not possible to control the timing of exposure.

SUMMARY OF THE INVENTION

In accordance with an aspect of the present invention, a printer for executing recording onto media, comprising a head and a rotary encoder, wherein the head and the media are moved relatively.

In the relative movement between the head and the media, the media may be moved relative to the immobile head, or the head may be moved relative to the immobile media.

The rotary encoder outputs pulses corresponding to relative positions between the head and the media. The head starts recording onto the media based on the pulses output by the rotary encoder.

When the pulses from the rotary encoder have not been output within a predetermined period of time, the printer starts recording onto the media based on a lapse of the predetermined period of time.

BRIEF DESCRIPTION OF THE DRAWINGS

The above object and features of the present invention will be more apparent from the following description of the preferred embodiments with reference to the accompanying drawings, wherein:

FIGS. 9A to 7D are views showing examples of a case where a slit of a rotary encoder has been filled;

DETAILED DESCRIPTION OF THE REFERRED EMBODIMENTS

First, there will be explained an instant film 100 as a photosensitive material that is used for an optical printer relating to the present invention, and a film cartridge 120 that accommodates a plurality of instant films 100.

Figure 1:
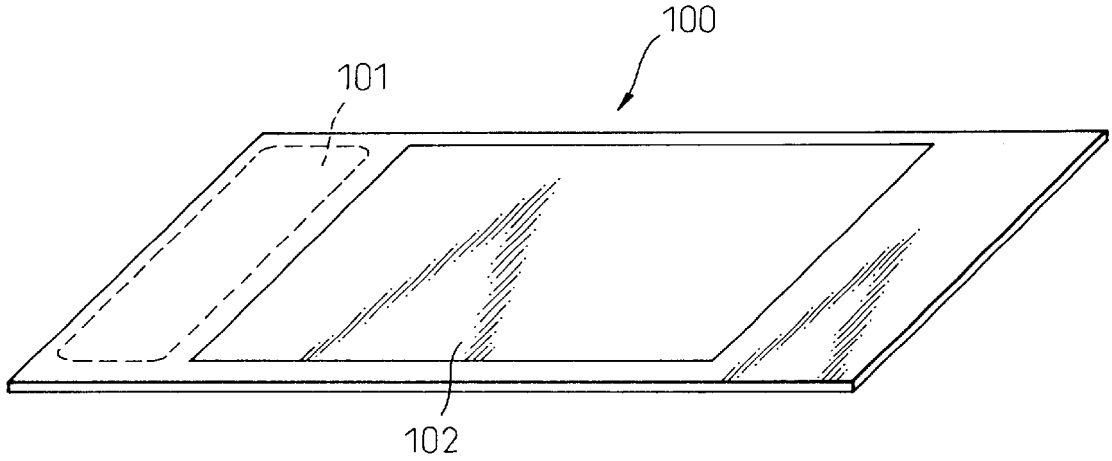
FIG. 1 is an outer view of an instant film.

FIG. 1 shows an outer view of the instant film 100. The instant film 100 has a developing solution pack 101 including self-developing solution at one end of the film. After exposing a photosensitive surface 102 in a dark place, the developing solution pack 101 at the front end is squeezed so as to spread the self-developing solution over the whole photosensitive surface 102, thereby to make it possible to execute development.

Figure 2:
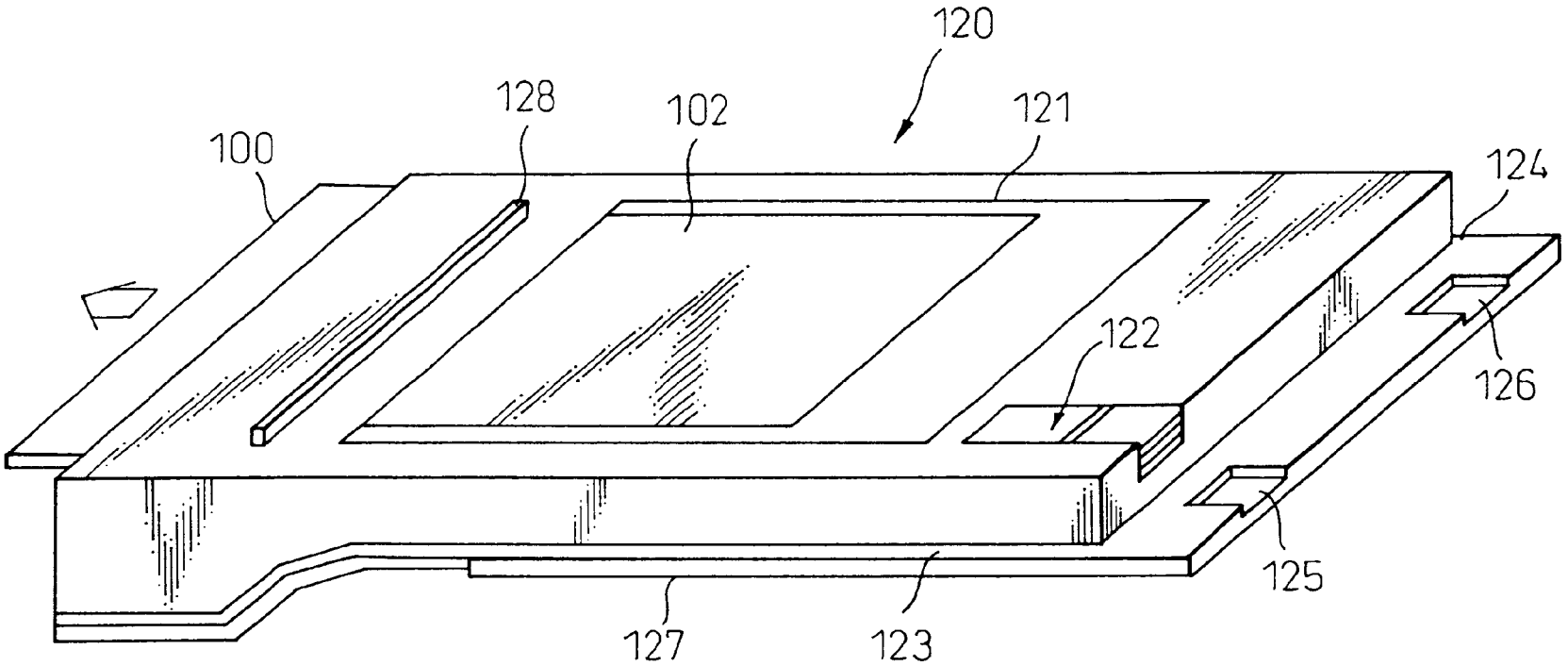
FIG. 2 is an outer view of a film cartridge.

FIG. 2 shows an outer view of the film cartridge 120. The instant film 100 is taken out from the film cartridge 120. It is necessary to convey the instant film 100 taken out from the film cartridge 120 to develop the film. The film cartridge 120 has a large opening portion 121 and a small opening portion 122. It is possible to touch the end portion of the instant film 100 contained in the cartridge, at the small opening portion 122. Further, the film cartridge 120 has edge portions 123 and 124 at both sides of the cartridge, and also has a battery 127 at a bottom portion of the cartridge. Battery power is supplied from the battery 127 through electrodes 125 and 126.

Figure 3:
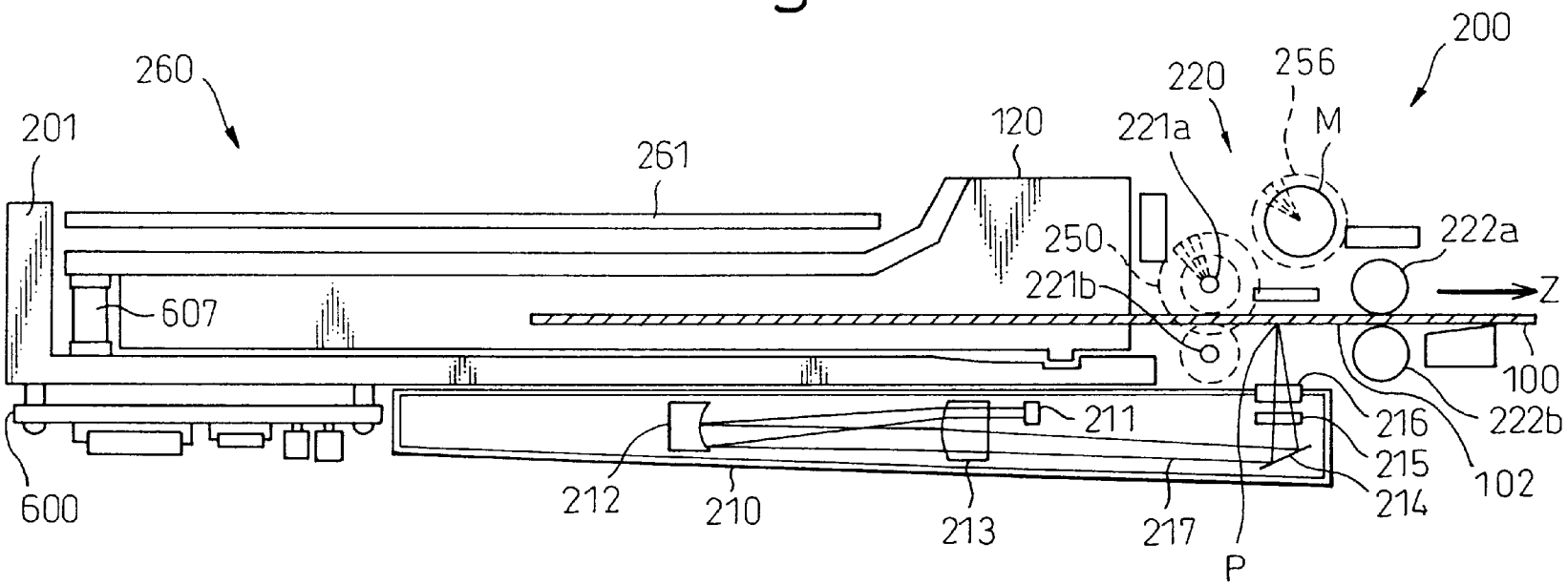
FIG. 3 is a cross-sectional view at approximately the center of an optical printer relating to the present invention.

An optical printer 200 relating to the present invention will be explained with reference to FIG. 3. FIG. 3 is a cross-sectional view approximately at the center of the optical printer 200. The optical printer 200 is constructed of three portions, i.e., a light head unit 210, a conveying unit 220, and a container 260.

The light head unit 210 includes an LED unit 211 in which three LEDs (approximately a red color, approximately a green color, and approximately a blue color) are adjacently arranged in a perpendicular direction, and used as a light source; a toroidal lens 213 having a plane surface and a cylindrical surface; a parabolic reflector 212 for changing a ray 217 emitted from the light source in a fan-like shape to a light flux in a parallel shape; a reflecting mirror 214 for reflecting the ray 217, in a downward direction, by 90 degrees, in which the parallel light flux passes again through the toroidal lens 213 and is collected at an exposure point P on the photosensitive surface 102 in a sharp line shape; a liquid-crystal light shutter array 215 for selectively transmitting or cutting the ray 217 emitted from the light source; and a masking member 216. The liquid-crystal light shutter array 215 can form a colored latent image having a structure in which each of the longitudinal and the traversal lengths per one pixel is 162 $\mu$m, and the image has 640 pixels×640 lines, on the photosensitive surface 102 of the instant film 100. A method of forming the latent image will be explained in detail hereinafter.

The conveying unit 220 is provided adjacent to the container 260 which contains the film cartridge 120, and conveys and ejects the instant film 100 used as a photosensitive material, in a direction Z by using a pair of conveying rollers 221*a* and 221*b,* and a pair of developing rollers 222*a* and 222*b.* The photosensitive surface 102 of the instant film 100 is exposed by the light unit 210 at the exposure point P during conveyance of the film, thereby to make it possible to form the latent image on the surface. The above-mentioned developing solution pack 101 is arranged at the front end of the instant film 100 and downstream in the conveying direction. The developing solution pack 101 is squeezed by the pair of developing rollers 222*a* and 222*b,* to gradually spread the self-developing solution over the photosensitive surface 102 from the developing solution pack 101 after exposure of the instant film 100. Accordingly, on the instant film 100 ejected from the optical printer 200, development of the latent image is completed after a predetermined period of time, and a colored image can be obtained.

Since the self-developing solution reacts with the photosensitive surface 102 to start the developing process, it is important that the self-developing solution is not brought into contact with the photosensitive surface 102 that has a non-exposed area. Therefore, as described above, each of the pair of conveying rollers 221*a* and 221*b* is structured to have a smaller diameter at a central portion of the roller. With this arrangement, even when the developing solution pack 102 has been squeezed by the pair of conveying rollers, the developing solution does not react with the photosensitive surface.

Further, a rotary encoder 250 is provided on a central shaft of the conveying roller 221*a,* and an exposure timing at the light head 210 can be obtained by a control circuit not shown, by using encoder pulses generated from the rotary encoder 250.

The pair of conveying rollers 221*a* and 221*b* and the pair of developing rollers 222*a* and 222*b* are structured to be able to be driven by a motor M. An M rotary encoder 255 is provided on a driving shaft of the motor M, and the rotation of the motor M is controlled using M encoder pulses generated from the M rotary encoder 255. The container 260 is structured to contain the film cartridge 120 held in a holder 261. A reference number 600 denotes a control circuit.

Figures 4A, 4B, 4C, 4D, 4E, 4F:
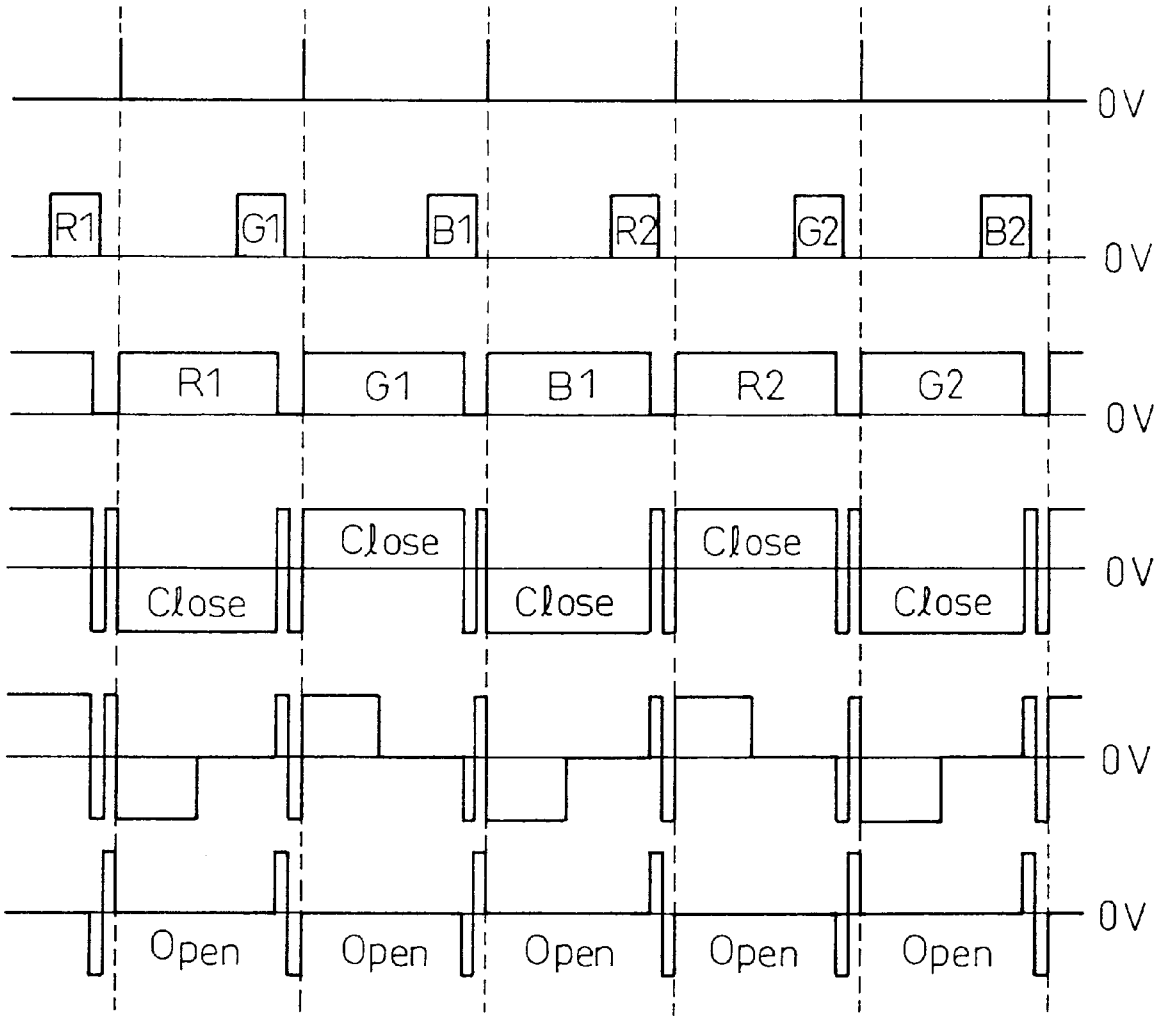
FIG. 4A is an explanatory view of encoder pulses.
FIG. 4B is a timing chart of data transfer.
FIG. 4C is an explanatory view of LED light-emission pulses.
FIGS. 4D to 4F are explanatory views of LCS pulses.

FIG. 4A is an explanatory view of encoder pulses generated by the rotary encoder 250, FIG. 4B is a timing chart of data transfer, FIG. 4C is an explanatory view of LED emission pulses supplied to the LED unit 211, and FIGS. 4D to 4F are explanatory views of LCS pulses supplied to the liquid crystal shutter array 215.

The liquid crystal shutter array 215 includes only one line of 640 liquid crystal shutter elements that can be separately opened or closed in the direction orthogonal to the conveying direction of the instant film 100 (see arrow Z in FIG. 3). Each shutter element transmits light when no voltage is applied to the element (0V), and cuts the light when a predetermined voltage is applied thereto. In other words, each shutter element is structured by what is called "normally white type" liquid crystal.

Each of the R, G and B elements of the LED of the LED unit 211 emits light by time-sharing. The line-shaped light formed by each of the R, G and B elements transmits the shutter elements of the liquid crystal shutter array 215 in the form of one line, and is focused at a predetermined pitch at a different location on the photosensitive surface 102.

As shown in FIG. 4B, corresponding to an encoder pulse immediately before, the image data is transferred in order to drive each shutter element of the liquid-crystal light shutter array 215. As shown in FIG. 4C, the LED light-emission pulse is generated in synchronism with each encoder pulse in FIG. 4A. The order R, G and B is repeated to make each LED of the LED unit 211 emit light in accordance with a predetermined time interval. The rotary encoder is provided coaxially with the conveying roller 211*a* to synchronize its operation with the conveyance of the instant film 100. Therefore, it is possible to prevent the quality of the image from being deteriorated due to the dispersion of the conveyance, since the LED light-emission pulse and LCS pulse are emitted in synchronism with the encoder pulse.

The LSC pulse shown in FIG. 4D is used to close the entire of the liquid-crystal light shutter array 215. A predetermined voltage is applied to all the shutter elements in order to close all elements during light emission of each color of the LED. In this case, after the development, a black color is generated on the photosensitive surface 102 of the instant film 100. The LCS pulse shown in FIG. 4E is used to close a half of the liquid-crystal light shutter array 215. A predetermined voltage is applied to the shutter elements in order to close all elements during a half period of the light emission of each color of the LED. In this case, after the development, a gray color is generated on the photosensitive surface 102 of the instant film 100. The LCS pulse shown in FIG. 4F is used to open the entire liquid-crystal light shutter array 215. No voltage is applied to any one of the elements in order to open all the shutter elements during the light emission of each color of the LED. In this case, after the development, a white color is generated on the photosensitive surface 102 of the instant film 100. As explained above, according to the embodiment of the present invention, it is possible to express 64 gradations for each color, by controlling the supply interval of a voltage to the liquid-crystal light shutter array 215.

At the end of the exposure of each color, a pair of positive/negative pulses are applied to all the shutter elements of the liquid-crystal light shutter array 215 in order to process the image, so as not to be influenced by the image immediately before, of each shutter element. Further, the polarity of the voltage applied to the liquid-crystal light shutter array 215 is inverted each time in order to prevent the liquid crystal from being deteriorated. It is assumed that there is no change in the open/close operation of each shutter element, even when the polarity of the voltage applied to the liquid-crystal light shutter array 215 has been changed.

Figure 5A:
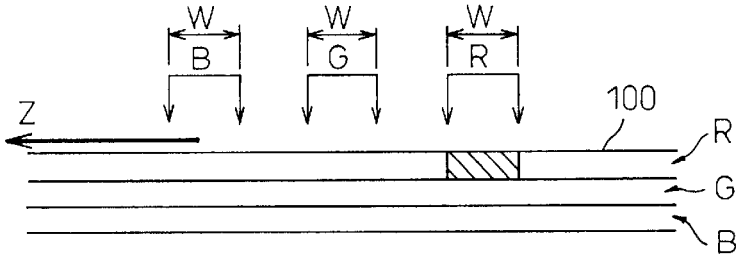
FIGS. 5A to 5F are views showing the outline of a latent-image formation process.

FIGS. 5A to 5F are views for explaining the process of forming the latent image on the instant film 100. It is assumed that the instant film 100 is conveyed by the conveying unit 220 to the direction shown by the arrow Z at a predetermined conveying speed. Further, it is assumed that the instant film 100 includes an R layer for forming the latent image reacted with the R light, a G layer for forming the latent image reacted with the G light, an B layer for forming the latent image reacted with the B light. As shown in FIG. 5A, each R, G and B light emitted from the light head unit 210 is focussed at a predetermined pitch interval on the photosensitive surface 102 of the instant film 100 as the image having a width W.

FIG. 5A shows a start timing of exposure using the R light.

Figure 5B:
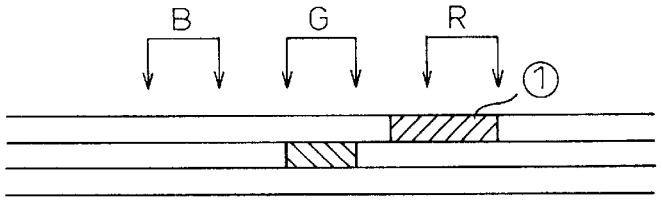

FIG. 5B shows a start timing of exposure using the G light. The exposure on a portion (1) of the R layer by the R light has been completed based on the lighting of the R light during a predetermined period of time, and based on the movement of the instant film 100.

Figure 5C:
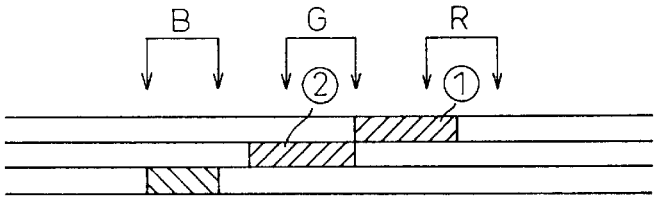

FIG. 5C shows a start timing of exposure using the G light. The exposure on a portion (2) of the G layer by the G light has been completed based on the lighting of the G light during a predetermined period of time, and based on the movement of the instant film 100.

Figure 5D:
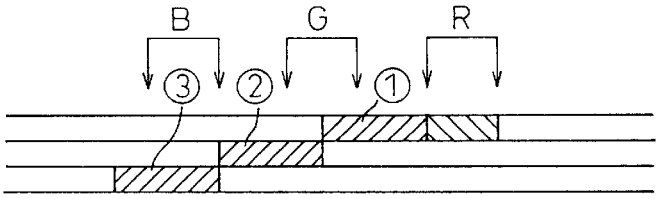

FIG. 5D shows a start timing of exposure using the R light again. The exposure on a portion (3) of the B layer by the B light has been completed based on the lighting of the B light during a predetermined period of time, and based on the movement of the instant film 100.

Figure 5E:
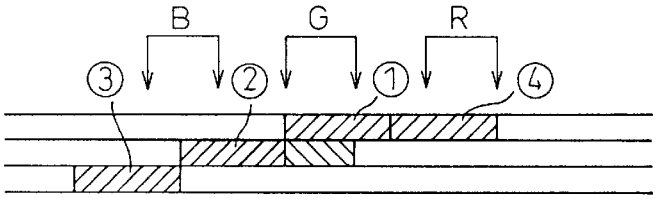
Figure 5F:
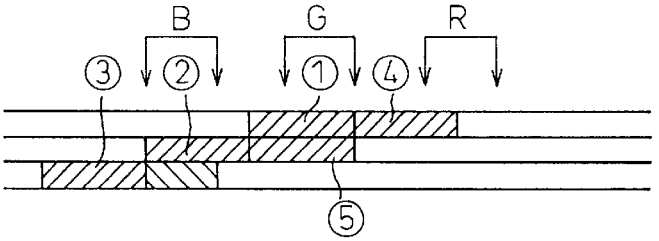

Similarly, the exposure on a portion (4) by the R light has been completed as shown in FIG. 5E, and the exposure on a portion (5) by the G light has been completed as shown in FIG. 5F. By repeating a similar process, it is possible to form the latent image on the instant film 100.

Figure 6:
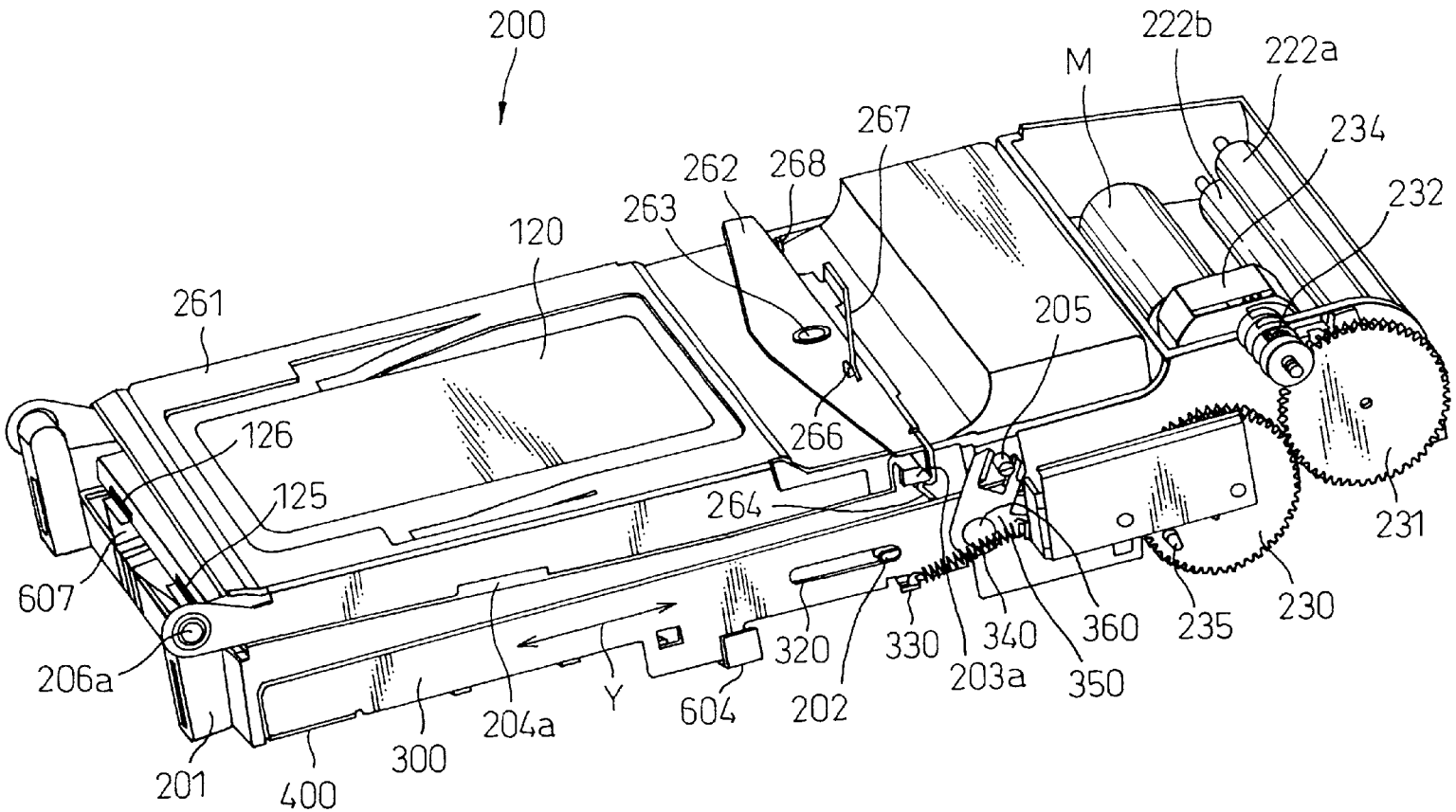
FIG. 6 is a perspective view of an optical printer.
Figure 7:
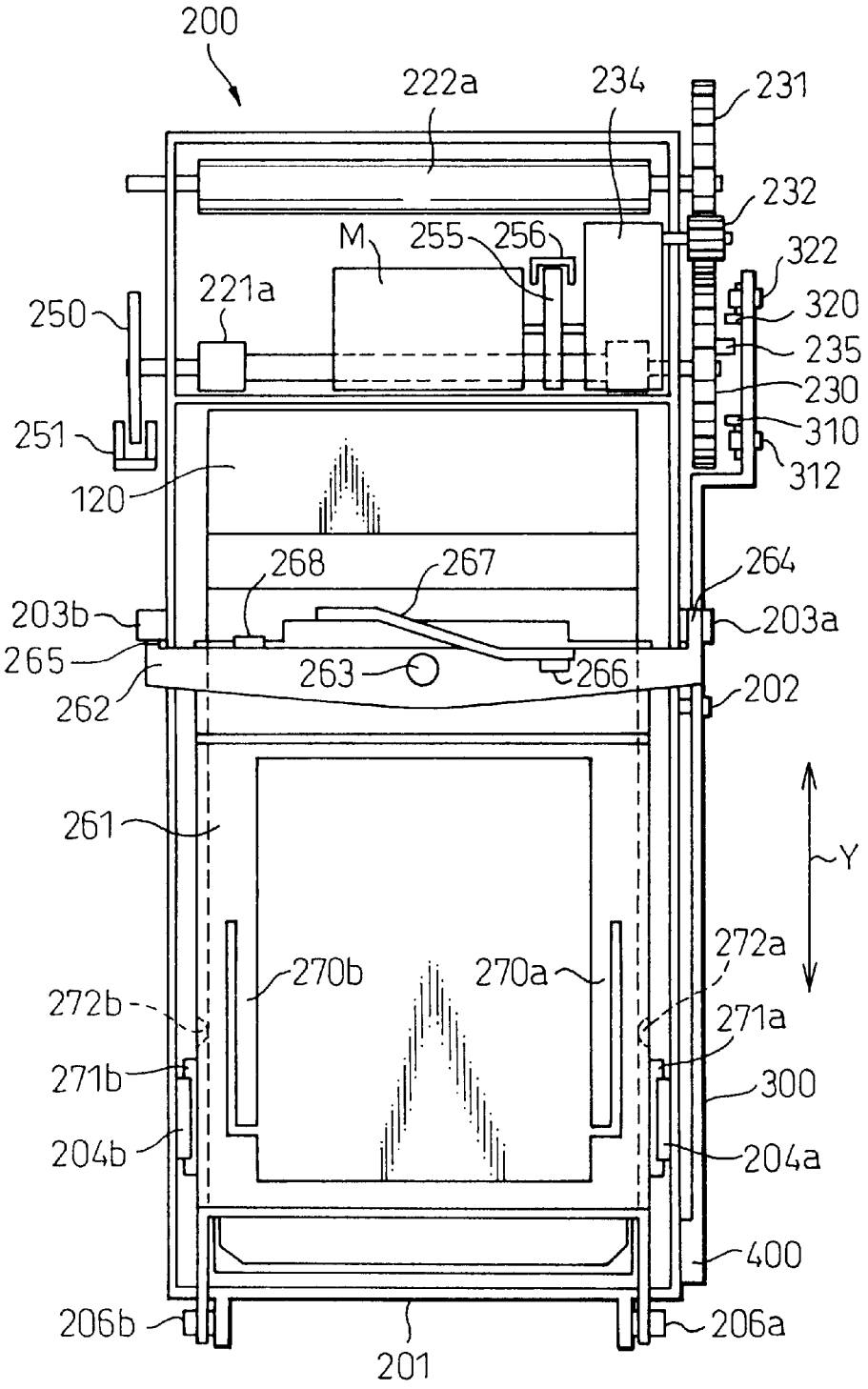
FIG. 7 is a plan view of an optical printer.

Next, a detailed structure of the optical printer 200 relating to the present invention will be explained with reference to FIG. 6 and FIG. 7. FIG. 6 is a perspective view of the optical printer 200, and FIG. 7 is a plane view of the optical printer 200 shown in FIG. 6.

In the drawing, M denotes a motor rotated forwards or backwards by the control circuit 600. The motor M rotates a gear 232 forwards or backwards via a gear box 234. The control circuit 600 controls the motor M based on M encoder pulses generated from an M encoder pulse generator 256 according to the rotation of the M rotary encoder provided on the driving shaft of the motor M. A gear 230 is provided coaxially with the conveying roller 221*b,* and a gear 231 is provided coaxially with the developing roller 222*a.* As shown in the drawing, the gear 232 is engaged with the gear 231, and the gear 231 is engaged with the gear 230. A pair of developing rollers 222*a* and 222*b* are driven in accordance with forward or backward rotation of the motor M through the gears 232 and 231. Further, a pair of conveying rollers 221*a* and 221*b* are driven through the gear 230.

A reference number 250 denotes a rotary encoder provided coaxially with the conveying roller 221*a.* A reference number 251 denotes an encoder pulse generator. The encoder pulse generator 251 generates encoder pulses (see FIG. 4A) in accordance with the rotation of the rotary encoder 250 in synchronism with the rotation of the conveying roller 221*a.* It is possible to utilize another structure instead of this structure when it is possible to generate precise pulses in synchronism with the conveyance of the instant film 100.

A reference number 120 denotes a film cartridge, and reference numbers 125 and 126 denote electrodes of a battery 127 provided on the film cartridge 120. The electrodes 125 and 126 supply battery power to the control circuit 600 via a connection point 607.

The holder 261 holds the film cartridge 120, and can be rotated around central shafts 206*a* and 206*b* provided on a box member 201. An engaging member 262 is provided on the upper surface of the holder 261. The holder 261 is engaged with the box member 201 by engaging front end portions 264 and 265 of the engaging member 262 with projected portions 203*a* and 203*b* provided on the box member 201.

The engaging member 262 can be rotated in the anti-clockwise direction around a central shaft 263 in FIG. 7. When the engaging member 262 is rotated, the engagements of the front end portions 264 and 265 with the projected portions 203*a* and 203*b* respectively are released so that the holder 261 can be rotated around the central shafts 206*a* and 206*b.* Further, projected portions 204*a* and 204*b* are provided on the box member 201. These projected portions are engaged with engaging members 271*a* and 271*b* provided on the holder 261 to make it possible to limit the rotation of the holder 261 to within a predetermined range. Further, it is possible to attach or remove the film cartridge 120 easily, when the holder 261 is rotated.

A projected portion 266 is fixed to the engaging member 262, and is engaged with the head portion of a plate spring 267 provided on the holder 261. Therefore, the engaging member 262 receives an energized force in the clockwise direction in FIG. 7 from the plate spring 267 through the projected portion 266. The engaging member 262 cannot rotate in the clockwise direction in excess of the position shown in FIG. 7 due to a stopper 268 provided on the holder 262. When the engaging member 262 is rotated to the anti-clockwise direction in FIG. 7, the energized force is applied to the engaging member 262 by the plate spring 267. Accordingly, when the engaging member 262 is rotated to the anti-clockwise direction in order to release the engagement between the head portions 264 and 265 and the projected portions 203*a* and 203*b* of the engaging member 262 respectively, it is possible to automatically return the engaging member 262 to the position shown in FIG. 7 using the plate spring 267.

A reference number 300 denotes a taking-out member, and this takes out the instant film 100 from the film cartridge 120 using a pick-up member 400 provided on one end of the taking-out member. A clutch mechanism is provided on the other end of the taking-out member 300, as mentioned hereinafter. The clutch mechanism reciprocally moves the taking-out member 300 in a direction of an arrow Y according to the forward/backward rotation of the gear 230, in co-operation with a projected portion 235 provided on the surface of the gear 230.

The taking-out member 300 has an opening portion 320, and is used for limiting the reciprocal movement of the taking-out member 300, in co-operation with the projection portion 202 of the box member 201. Further, the taking-out member 300 has a rotational member 350 that can be freely rotated around a shaft 360. Further, the taking-out member 300 has a projected portion 330, and has a spring member 340 mounted between the projected portion 330 and the rotational portion 350. Further, the rotational member 350 can be rotated within a range limited by a cylindrically-shaped projection portion 205 provided in the box member 201.

Figure 8:
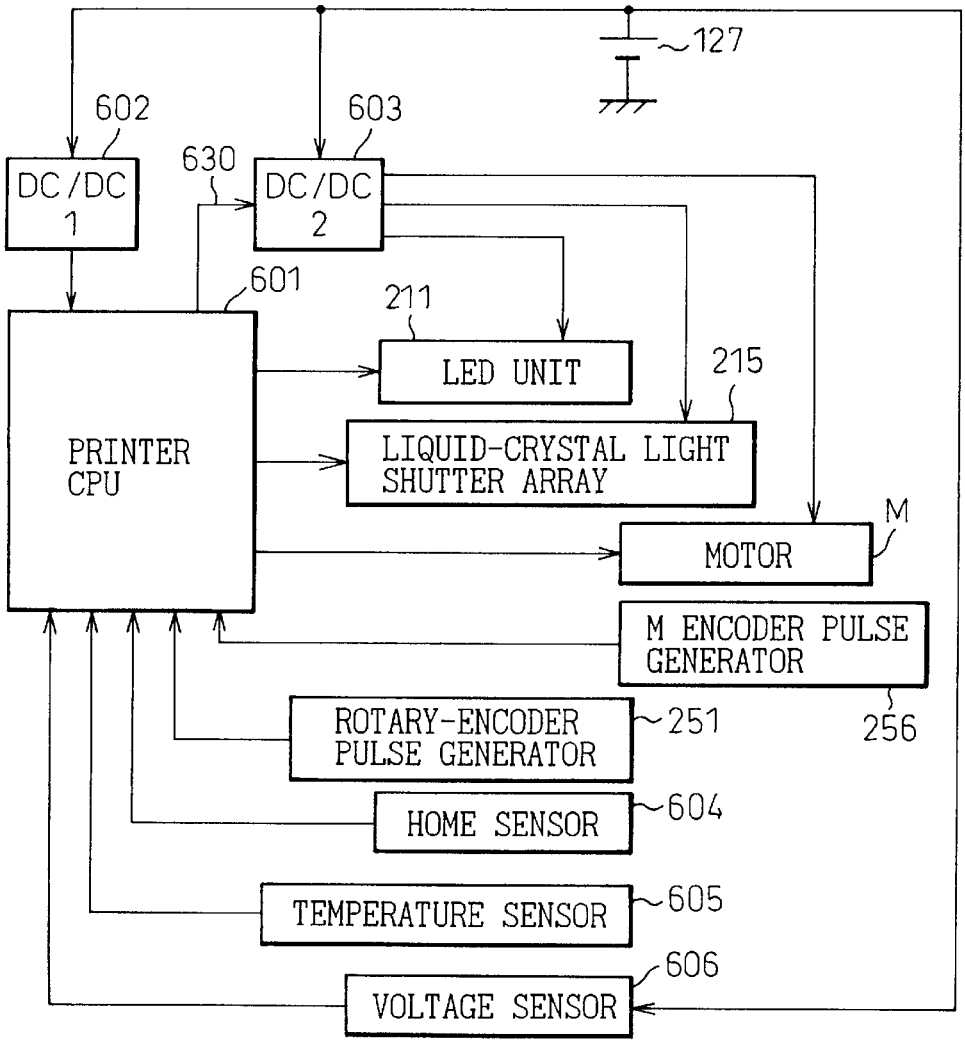
FIG. 8 is a block diagram showing the outline of a control circuit of an optical printer.

FIG. 8 is a block diagram showing an outline of the control circuit 600 of the optical printer. In FIG. 8, a reference number 601 denotes a printer CPU, 602 denotes a first DC/DC converter, 603 denotes a second DC/DC converter, and 604 denotes a home sensor for detecting a home position of the taking-out member 300 (that is, a home position of the picking-up member). A reference number 605 denotes a temperature sensor provided near the film cartridge 120, and 606 denotes a voltage sensor for detecting a voltage of the battery 127 of the film cartridge 120. A reference number 211 denotes an LED unit, 215 denotes a liquid-crystal light shutter array, M denotes a motor, and 256 denotes an M encoder pulse generator for generating M encoder pulses from the encoder 255 provided on the driving shaft of the motor M. A reference number 251 denotes an encoder pulse generator for generating rotary encoder pulses from the rotary encoder 250.

The first DC/DC converter 602 converts a voltage of the battery 127 of the film cartridge 120 into a driving voltage (3V) of the printer CPU 601, and applies this driving voltage to the printer CPU 601. The second DC/DC converter 603 converts a voltage of the battery 127 of the film cartridge 120 into driving voltages of the LED unit 211, the liquid-crystal light shutter array 215, and the motor M respectively, and applies these voltages to these corresponding units. The application of the voltages from the second DC/DC converter 603 to the respective units is controlled based on a control signal 630 from the printer CPU 601.

The printer CPU 601 controls the motor M to rotate it at a predetermined number of rotations, based on the M encoder pulses from the M encoder pulse generator 256. Further, the printer CPU 601 controls the LED unit 211 and the liquid-crystal light shutter array 215, based on the encoder pulses from the rotary-encoder pulse generator 251 (see FIG. 4).

With reference to FIGS. 9A to 9D, there will be explained a case where a slit of the rotary encoder 250 has been filled with dust or the like, and the rotary encoder 250 cannot generate accurate encoder pulses. The rotary encoder 250 has a plurality of slits formed on a circular disk, in a circumferential direction from the center of the disk. The encoder pulse generator 251 is structured as follows. The rotary encoder 250 rotates in synchronism with the rotation of the conveying roller 221*a,* and then, the plurality of slits formed on the rotary encoder 250 rotate. The encoder pulse generator 251 generates pulses based on the rotation of these slits. A transmission-type optical sensor or the like is used for the encoder pulse generator 251. Therefore, when any one or more of the slits formed on the rotary encoder 250 have been filled with dust or the like, it is not possible to generate encoder pulses corresponding to these filled slits.

Figures 9A, 9B, 9C, 9D:
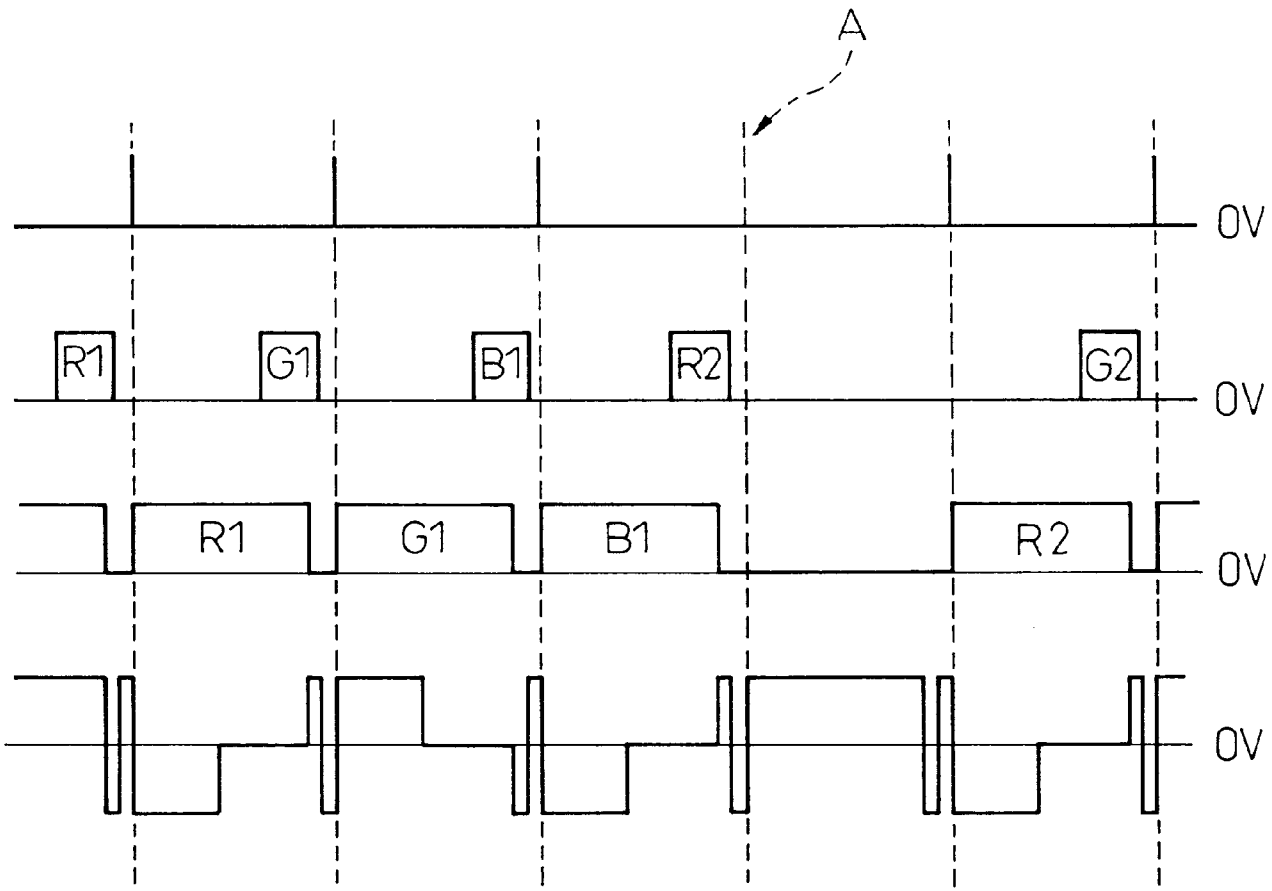

FIG. 9A shows encoder pulses, FIG. 9B shows data transmission timings, FIG. 9C shows LED light-emission pulses, and FIG. 9D shows LCS pulses. In FIG. 9A, encoder pulses are shown in a status that no pulse has been generated at a point A since a predetermined slit has been filled with dust. As explained with reference to FIGS. 4A to 4F, data transmission timings, LED light-emission pulses, and LCS pulses are all generated based on the encoder pulses (FIG. 4A). Therefore, when the encoder pulse is not generated at the point A in FIG. 9A, data transmission timing, an LED light-emission pulse, and an LCS pulse corresponding to this pulse cannot be generated. As a result, on the instant film 100, an image of one line is skipped.

Figures 10A, 10B, 10C, 10D:
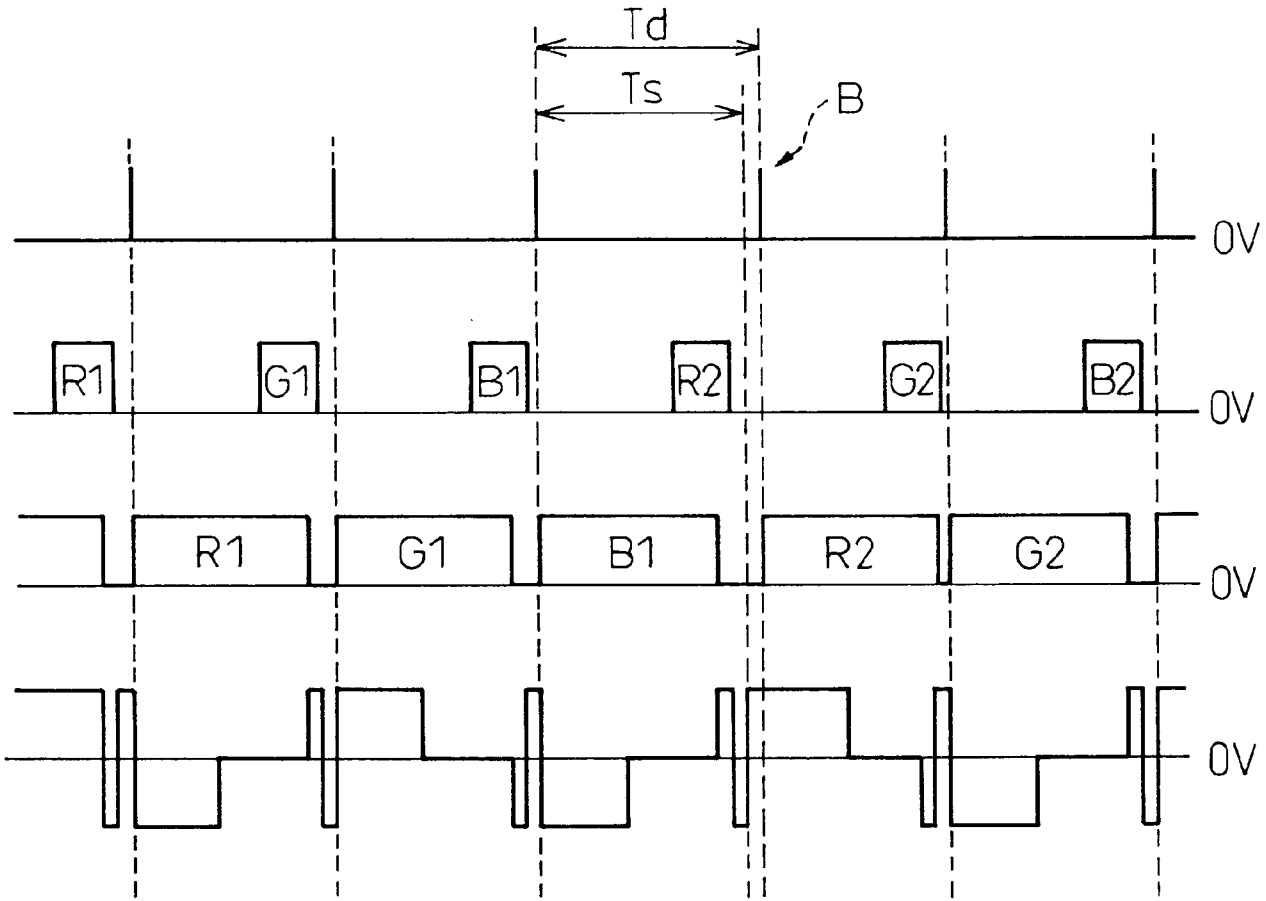
FIGS. 10A to 10D are views showing examples of a case where a dummy pulse has been generated.

With reference to FIGS. 10A to 10D, there will be explained a case where a dummy pulse has been generated when a slit of the rotary encoder 250 has been filled with dust or the like and the rotary encoder 250 cannot generate accurate encoder pulses. Like FIGS. 9A to 9D, FIG. 10A shows encoder pulses, FIG. 10B shows data transmission timings, FIG. 10C shows LED light-emission pulses, and FIG. 10D shows LCS pulses. FIG. 10A shows a case where a dummy pulse has been generated at a point B after a lapse of Td seconds from the generation of an encoder pulse immediately before. Based on this dummy pulse, a data transmission timing, an LED light-emission pulse, and an LCS pulse are generated. With this structure, it is possible to form a satisfactory image without skipping an image of one line, although a slight delay occurs. The time of Td is set to about 700 $\mu$s or 1,500 $\mu$s longer than a time Ts that is the time when a next encoder pulse is considered to be generated in the normal case.

Figure 11:
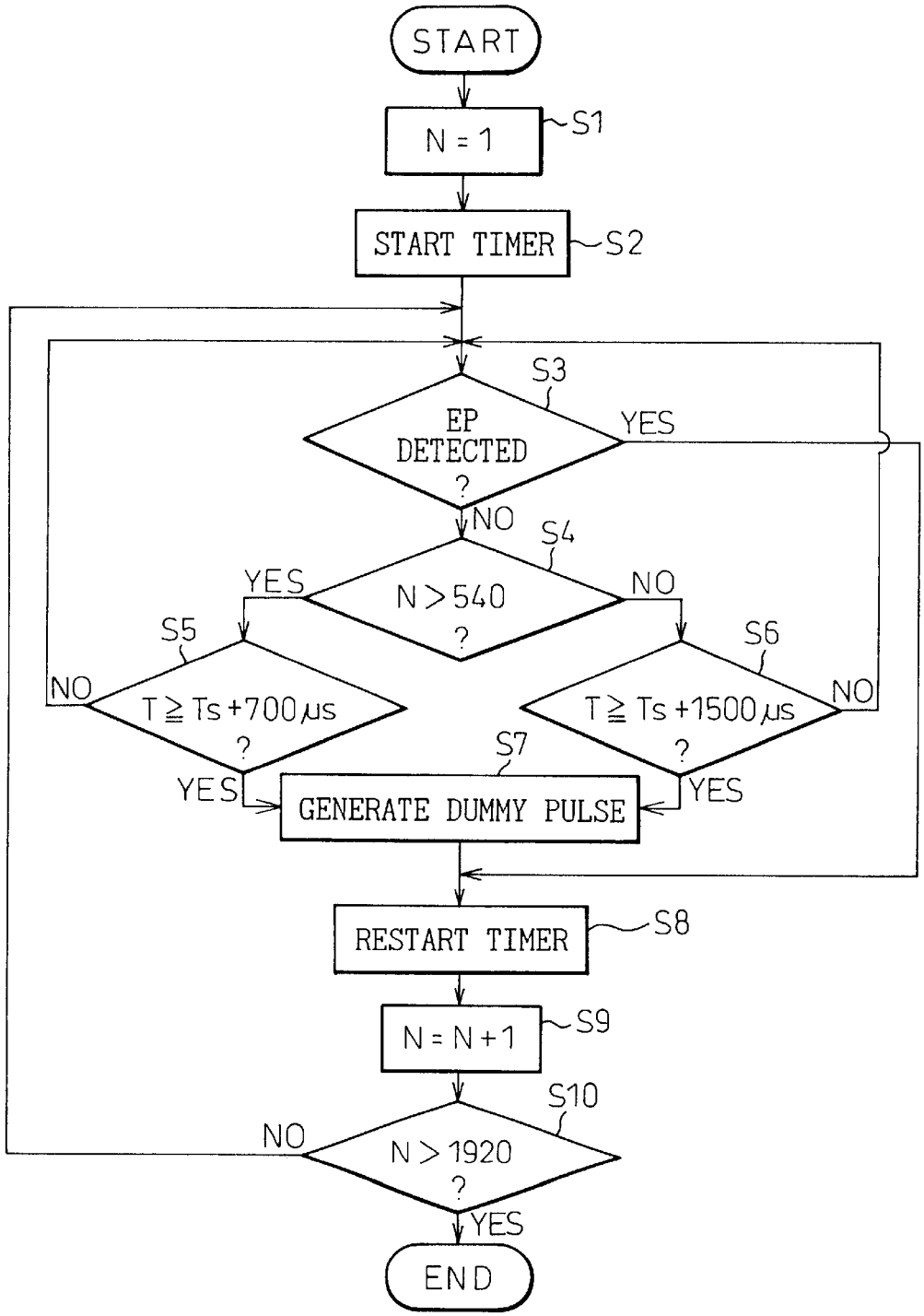
FIG. 11 is a flowchart showing a sequence of generating a dummy pulse.

A process of generating dummy pulses will be explained with reference to FIG. 11. First, N=1 is set (step S1). N represents a number of lines to be exposed on the instant film. As explained with reference to FIGS. 5A to 5F, a full-color latent image for one line is formed based on the exposure of the three lines of R, G and B. A latent image of 640 lines in total is formed on the photosensitive surface 102 of the instant film 100. In other words, based on the exposure of R, G and B, 1,920 lines in total (=640×3) are exposed.

Next, the timer is started (step S2).

Next, a decision is made as to whether an EP (encoder pulse) has been detected or not (step S3). When an EP has not been detected, the process proceeds to step S4, and a decision is made as to whether N is larger than 540 or not. When N is equal to or smaller than 540, this means that, as the load applied to the instant film at an initial stage, after the exposure has been started, is different from another situation, the generation timing of a dummy pulse has been changed. This will be explained in detail later.

When N is larger than 540, the process proceeds to step S5. Then, a decision is made as to whether a count time T of the timer is equal to or larger than Ts+700 $\mu$s or not. Ts is a preset value, and this represents a time that is considered to be required from the generation of one encoder pulse till the generation of a next encoder pulse in a normal status. When T is smaller than Ts+700 $\mu$s, the process returns to step S3, and a decision is made again about a detection of an EP. When T is equal to or larger than Ts+700 $\mu$s, the process proceeds to step S7, and a dummy pulse is generated. In other words, when an EP is not generated even after a lapse of 700 $\mu$s since Ts, a dummy pulse is generated at a point of time when Td is equal to Ts+700 $\mu$s. In a predetermined implementation status, Ts has been set equal to 4,200 $\mu$s.

When N is equal to or smaller than 540 at step S4, the process proceeds to step S6, and a decision is made as to whether the count time T of the timer is equal to or larger than Ts+1,500 $\mu$s or not. When T is smaller than Ts+1,500 $\mu$s, the process returns to step S3, and a decision is made again about a detection of an EP. When T is equal to or larger than Ts+1,500 $\mu$s, the process proceeds to step S7, and a dummy pulse is generated. In other words, when an EP is not generated even after a lapse of 1,500 $\mu$s since Ts, a dummy pulse is generated.

Next, the timer is restarted (step S8), and N is replaced with N+1 (step S9).

Next, a decision is made as to whether N is larger than 1,920 or not. When N is equal to or smaller than 1,920, the process returns to step S3, and the above process is repeated. When N is larger than 1,920, the process finishes. That is, a latent image of 640 lines has been formed on the photosensitive surface 102 of the instant film 100.

It is preferable to arrange as follows. When dummy pulses have been generated a predetermined number of times or more times during a period while the rotary encoder 250 rotates by a predetermined number of rotations, a decision is made that this is abnormal, and a display is made to this effect. Otherwise, there is a risk that a satisfactory image is damaged. For example, a decision is made that the situation is abnormal when dummy pulses have been generated ten or more times during one rotation of the rotary encoder 250.

Figures 12A, 12B, 12C:
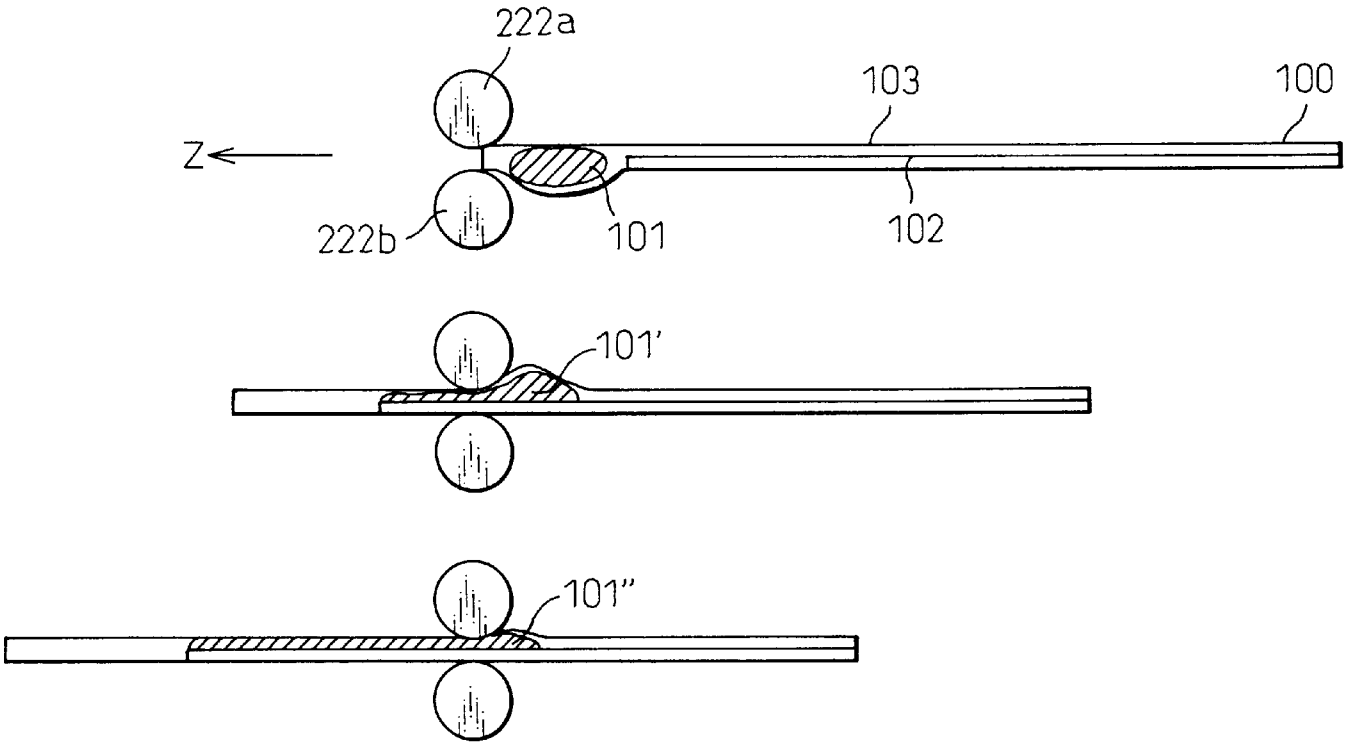
FIGS. 12A to 12C are explanatory views of a behavior of a self-developing solution in an instant film.

FIGS. 12A to 12C are views for explaining the load applied to the instant film 100. As described previously, the developing solution pack 101 is provided at an end portion of the instant film 100. The developing solution pack 101 is squeezed by the pair of developing rollers 222*a* and 222*b,* and the self-developing solution is spread over the photosensitive surface 102 of the instant film, thereby to start the developing. In FIGS. 12A to 12C, reference number 103 denotes a transparent film for protecting the photosensitive surface 102 of the instant film. The self-developing solution squeezed out from the developing solution pack 101 passes through between the photosensitive surface 102 and the transparent film 103, and is spread over the whole photosensitive surface 102.

FIG. 12A shows a status immediately before the developing solution pack 101 is squeezed. FIG. 12B shows a status immediately after the developing solution pack 101 is squeezed. FIG. 12C shows a status that the spreading of the self-developing solution between the photosensitive surface 102 and the transparent film 103 is progressing. As can be understood from FIGS. 12A to 12C, a large load is applied to the pair of developing rollers 222*a* and 222*b* to squeeze the developing solution pack 101 and to spread the self-developing solution as much as possible, immediately before and after the squeezing of the developing solution pack 101. On the other hand, after the self-developing solution has been spread to some extent (see FIG. 12C), the possibility that a high load is applied to the pair of developing rollers 222*a* and 222*b* is small.

Therefore, at the initial stage of conveying the instant film 100, there is a possibility that the speed of conveying the instant film 100 drops. To overcome this situation, with the exposure of the 540-th line (180×3) as a boundary, the time of waiting for a generation of an EP is switched from Ts+1,500 $\mu$s to Ts+700 $\mu$s. In other words, a generation of an EP is awaited for a longer time at the beginning since the starting of the conveying of the instant film. When the exposure of a predetermined number of lines has been finished since the starting of the conveying of the instant film, a generation of an EP is awaited for a shorter time.

The time for the timer to count for generating the dummy pulses is not limited to Ts+700 $\mu$s or Ts+1,500 $\mu$s, and it is also possible to select a suitable time depending on the situation. Accordingly, it is also possible to generate a dummy pulse immediately after a lapse of time Ts.

As explained above, even when a slit of the rotary encoder has been filled and an encoder pulse cannot be generated, it is possible to prevent skipping of an image by generating a dummy pulse.

In the above explanation, a dummy pulse is generated after a lapse of a predetermined period of time. Instead of generating a dummy pulse for the first time after a lapse of a predetermined period of time, it is also possible to arrange as follows. The encoder is rotated in advance to detect a position where an encoder pulse cannot be properly generated due to filled slit, and this is stored in a memory. With this arrangement, it is possible to generate a dummy pulse without waiting for a lapse of a predetermined period of time.

Further, in the above explanation, the timing of transferring data, the timing of generating an LED light-emission pulse, and the timing of generating an LCS pulse have been controlled based on a dummy pulse. However, it is also possible to arrange such that the printer CPU 601 directly takes the timing of transferring data, the timing of generating an LED light-emission pulse, and the timing of generating an LCS pulse, without generating a dummy pulse.

In the above explanation, exposure is executed by conveying the instant film 100 as a photosensitive material, with the light head 210 fixed. Conversely, it is also possible to execute the exposure by moving the light head 210, with the photosensitive material fixed. In this case, it is possible to provide a rotary encoder on a rotary shaft that rotates in synchronism with the movement of the light head 210, and to control a timing of exposure by using encoder pulses generated from the rotary encoder.

In any case, it is preferable that a rotary encoder is provided for detecting a relative position between the light head portion and the photosensitive material.

Summarizing the advantageous effects of the present invention, there is provided a printer for executing a recording on a media, the printer comprising: a head for recording on the media; a rotary encoder for detecting a relative position between the head and the media; and an encoder pulse generator for generating encoder pulses in synchronism with the rotary encoder, wherein the head and the media are relatively moved, and when the encoder pulse has been generated within a predetermined period of time, the head is controlled to start recording onto the media based on the encoder pulse, and when the encoder pulse has not been generated within a predetermined period of time, the head is controlled to start a recording onto the media based on a lapse of a predetermined period of time.

In the above printer, an abnormality detection signal is generated when the number of times of starting the recording onto the media by controlling the head based on the lapse of the predetermined period of time has exceeded a predetermined number, during a period while the rotary encoder rotates by a predetermined number of rotations.

Further, in the above printer, the head executes a line-scanning recording for recording at least each one line onto the media.

Further, there is provided a printer for forming an image by irradiating a light onto a photosensitive material, the printer comprising: a light head having a light source and a light shutter for selectively transmitting or interrupting a light from the light source to the photosensitive material; a rotary encoder for detecting a relative position between the light head and the photosensitive material; and an encoder pulse generator for generating encoder pulses synchronous with the rotary encoder, wherein the light head and the photosensitive material are relatively moved, and when the encoder pulse has been generated within a predetermined period of time, the light head is controlled to start an irradiation of the light onto the photosensitive material based on the encoder pulse, and when the encoder pulse has not been generated within a predetermined period of time, the light head is controlled to start an irradiation of the light onto the photosensitive material based on a lapse of a predetermined period of time.

In the above printer, an abnormality detection signal is generated when the number of times of starting the irradiation of the light onto the photosensitive material by controlling the light head based on the lapse of the predetermined period of time has exceeded a predetermined number, during a period while the rotary encoder rotates by a predetermined number of rotations.

Further, in the above printer, the light head and the photosensitive material carry out a relative movement during a period while the light from the light source is being irradiated onto the photosensitive material.

Further, in the above printer, the light head executes line scanning for irradiating the light for at least each one line onto the photosensitive material.

Further, in the above printer, the light source has a light-emitting element approximately of a red color, a light-emitting element approximately of a blue color, and a light-emitting element approximately of a green color.

Further, in the above printer, the light-emitting element approximately of a red color, the light-emitting element approximately of a blue color, and the light-emitting element approximately of a green color are light-emitting diodes.

Further, in the above printer, the light shutter is a liquid crystal shutter.

Further, in the above printer, the photosensitive material is an instant film incorporating a self-developing solution.

Further, there is provided a printer for forming an image by irradiating a light from a light head onto an instant film at a predetermined timing during a period while the instant film incorporating a self-developing solution is being moved continuously, wherein the light head has a light source having at least a light-emitting diode approximately of a red color, a light-emitting diode approximately of a blue color, and a light-emitting diode approximately of a green color, and a liquid-crystal light shutter for selectively transmitting or interrupting a light from the light source to the instant film, a relative position between the light head and the photosensitive material is detected based on pulses output in synchronism with a rotation of a rotary encoder, and when the pulse has been generated within a predetermined period of time, the light head is controlled to start an irradiation of the light onto the photosensitive material based on the pulse, and when the encoder pulse has not been generated within a predetermined period of time, the light head is controlled to start an irradiation of the light onto the photosensitive material based on a lapse of a predetermined period of time.

In the above printer, the light-emitting diode approximately of a red color, the light-emitting diode approximately of a blue color, and the light-emitting diode approximately of a green color emit light with a time gap between the emissions based on time-shared driving.

Further, the above printer comprises a developing roller for executing development by squeezing the self-developing solution while the instant film is being conveyed.

Further, the above printer comprises a conveying roller, for conveying the instant film, separately from the developing roller.

Further, according to the above printer, the rotary encoder is fixedly provided on the rotary shaft of the conveying roller coaxially with this rotary shaft.

What is claimed is:

1. A printer for executing recording on media, the printer comprising:

a head for recording on the media;

a rotary encoder for detecting a relative position between the head and the media; and an encoder pulse generator for generating encoder pulses in synchronism with the rotary encoder, wherein the printer makes a relative movement between the head and the media, and when the encoder pulse has been generated within a predetermined period of time, the printer controls the head to start a recording onto the media based on the encoder pulse, and when the encoder pulse has not been generated within the predetermined period of time, the printer controls the head to start a recording onto the media based on a lapse of the predetermined period of time.

2. The printer, as claimed in claim 1, wherein the printer generates an abnormality detection signal when the number of times of starting the recording onto the media by controlling the head based on the lapse of the predetermined period of time has exceeded a predetermined number, during a period while the rotary encoder rotates by a predetermined number of rotations.

3. The printer, as claimed in claim 1, wherein the head executes a line-scanning recording for recording at least each one line onto the media.

4. A printer for forming an image by irradiating a light onto a photosensitive material, the printer comprising:

a light head having a light source and a light shutter for selectively transmitting or interrupting a light from the light source to the photosensitive material;

a rotary encoder for detecting a relative position between the light head and the photosensitive material; and an encoder pulse generator for generating encoder pulses synchronous with the rotary encoder, wherein the printer produces a relative movement between the light head and the photosensitive material, and when the encoder pulse has been generated within a predetermined period of time, the printer controls the light head to start an irradiation of the light onto the photosensitive material based on the encoder pulse, and when the encoder pulse has not been generated within the predetermined period of time, the printer controls the light head to start an irradiation of the light onto the photosensitive material based on a lapse of the redetermined eriod of time.

5. The printer, as claimed in claim 4, wherein the printer generates an abnormality detection signal when the number of times of starting the irradiation of the light onto the photosensitive material by controlling the light head based on the lapse of the predetermined period of time has exceeded a predetermined number, during a period while the rotary encoder rotates by a predetermined number of rotations.

6. The printer, as claimed in claim 4, wherein the printer produces the relative movement between the light head and the photosensitive material during a period while the light from the light source is being irradiated onto the photosensitive material.

7. The printer, as claimed in claim 4, wherein the light head executes line scanning for irradiating the light for at least each one line onto the photosensitive material.

8. The printer, as claimed in claim 4, wherein the light source has a light-emitting element approximately of a red color, a light-emitting element approximately of a blue color, and a light-emitting element approximately of a green color.

9. The printer, as claimed in claim 8, wherein the light-emitting element approximately of a red color, the light-emitting element approximately of a blue color, and the light-emitting element approximately of a green color are light-emitting diodes.

10. The printer, as claimed in claim 4, wherein the light shutter is a liquid crystal shutter.

11. The printer, as claimed in claim 4, wherein the photosensitive material is an instant film incorporating a self-developing solution.

12. A printer for forming an image by irradiating a light from a light head onto an instant film at a predetermined timing during a period in which the instant film incorporating a self-developing solution is being moved continuously, wherein the light head has a light source having at least a light-emitting diode approximately of a red color, a light-emitting diode approximately of a blue color, and a light-emitting diode approximately of a green color, and a liquid-crystal light shutter for selectively transmitting or interrupting a light from the light source to the instant film, the printer detects a relative position between the light head and the photosensitive material based on pulses output in synchronism with a rotation of a rotary encoder, and when the pulse has been generated within a predetermined period of time, the printer controls the light head to start an irradiation of the light onto the photosensitive material based on the pulse, and when the encoder pulse has not been generated within the predetermined period of time, the printer controls the light head to start irradiation of the light onto the photosensitive material based on a lapse of the predetermined period of time.

13. The printer, as claimed in claim 12, wherein the light-emitting diode approximately of a red color, the light-emitting diode approximately of a blue color, and the light-emitting diode approximately of a green color emit light with a time shift between the emissions based on time-shared driving.

14. The printer, as claimed in claim 12, comprising:

a developing roller for executing development by squeezing the self-developing solution while the instant film is being conveyed.

15. The printer, as claimed in claim 14, comprising:

a conveying roller for conveying the instant film separately from the developing roller.

16. The printer, as claimed in claim 15, wherein the rotary encoder is fixedly provided on the rotary shaft of the conveying roller and is coaxial with this rotary shaft.

* * * * *

UNITED STATES PATENT AND TRADEMARK OFFICE

CERTIFICATE OF CORRECTION

PATENT NO. : 6,654,043 B2
DATED : November 25, 2003
INVENTOR(S) : Toshiyuki Inage et al.

It is certified that error appears in the above-identified patent and that said Letters Patent is hereby corrected as shown below:

Title page,
Item [57], delete the ABSTRACT in its entirety and substitute therefor:

-- A printer having a head moveable relative to a print media, a rotary encoder which outputs pulses corresponding to relative position between the head and the media, wherein the head starts recording onto the media based on the pulses output by the rotary encoder, and when the pulses from the rotary encoder have not been output within a predetermined period of time, the head start recording onto the media based on a lapse of the predetermined period of time. --.

Column 12,
Line 18, "redetermined eriod" should read -- predetermined period --.

Signed and Sealed this

Fourth Day of January, 2005

JON W. DUDAS
*Director of the United States Patent and Trademark Office*